US006543073B2

(12) United States Patent
Wu

(10) Patent No.: US 6,543,073 B2
(45) Date of Patent: Apr. 8, 2003

(54) INFLATION SEAT ASSEMBLY FOR AN INFLATABLE ARTICLE

(76) Inventor: Hsin-Tsai Wu, 1F, No. 19, Alley 3, Lane 106, Sec. 3, Min-Chuan E. Rd., Taipei City (TW)

( * ) Notice: Subject to any disclaimer, the term of this patent is extended or adjusted under 35 U.S.C. 154(b) by 23 days.

(21) Appl. No.: 09/939,882

(22) Filed: Aug. 27, 2001

(65) Prior Publication Data

US 2003/0037378 A1 Feb. 27, 2003

(51) Int. Cl.[7] ..... A47C 27/08
(52) U.S. Cl. ..... 5/713; 5/706; 5/655.3
(58) Field of Search ..... 5/713, 706, 708, 5/655.3

(56) References Cited

U.S. PATENT DOCUMENTS 4,766,628 A * 8/1988 Walker ..... 5/706
4,862,921 A * 9/1989 Hess ..... 5/713
5,367,726 A * 11/1994 Chaffee ..... 5/706
5,746,873 A * 5/1998 Graf ..... 5/708
6,287,095 B1 * 9/2001 Saputo et al. ..... 5/708
6,321,400 B1 * 11/2001 Gulino ..... 5/706
6,332,760 B1 * 12/2001 Chung ..... 5/706

* cited by examiner

*Primary Examiner*—Frederick L. Lagman
(74) *Attorney, Agent, or Firm*—Akin, Gump, Strauss, Hauer & Feld, L.L.P.

(57) ABSTRACT

An inflation seat assembly is adapted for connecting an inflatable article to a motor-driven air pump. The air pump has air inlet and outlet ports, and is operable so as to draw and supply air via the air inlet and air outlet ports, respectively. The inflation seat assembly includes a casing, an inlet check valve, an air outlet, and a closure member. The casing has a base wall, a peripheral wall, and a skirt flange. The base and peripheral walls cooperate to form a receiving space for retaining the air pump removably therein. The inlet check valve can be coupled to the air outlet port of the air pump, and permits air flow into the inflatable article. The air outlet is in fluid communication with the inflatable article. The closure member is used to close selectively the air outlet.

14 Claims, 4 Drawing Sheets

INFLATION SEAT ASSEMBLY FOR AN INFLATABLE ARTICLE

BACKGROUND OF THE INVENTION

1. Field of the Invention

The invention relates to an inflation seat assembly, more particularly to an inflation seat assembly for connecting an inflatable article to a motor-driven air pump.

2. Description of the Related Art

Referring to FIG. 1, a conventional inflatable article 100 is generally provided with an inflation valve 200. Air is supplied into the inflatable article 100 by blowing or by a motor-driven air pump 300. The inflation valve 200 is a check valve that can prevent the air in the inflatable article 100 from escaping via the inflation valve 200.

Since the inflation valve 200 has a very simple construction, it cannot be relied upon to effectively achieve the purpose of preventing the air in the inflatable article 100 from escaping. Furthermore, since the inflation valve 200 is relatively small, coupling of the air pump 300 to the inflation valve 200 for supplying air into the inflatable article 100 is inconvenient to conduct.

SUMMARY OF THE INVENTION

Therefore, the main object of the present invention is to provide an inflation seat assembly that is capable of overcoming the aforementioned drawbacks of the prior art.

Another object of the present invention is to provide an air inflatable assembly that is clear of the aforementioned drawbacks of the prior art.

According to one aspect of this invention, there is provided an inflation seat assembly adapted for connecting an inflatable article to a motor-driven air pump. The air pump has an air inlet port and an air outlet port, and is operable so as to draw air via the air inlet port and to supply air via the air outlet port. The inflation seat assembly comprises a casing, an inlet check valve, an air outlet, and a closure member. The casing has a base wall, a peripheral wall extending in a transverse direction from a periphery of the base wall, and a skirt flange extending outwardly from the peripheral wall. The base wall and the peripheral wall cooperate to form a receiving space that is adapted to retain the air pump removably therein. The casing is adapted to be extended into the inflatable article, and is adapted to be connected sealingly to the inflatable article such that the receiving space is accessible externally of the inflatable article. The inlet check valve is disposed on the base wall, is adapted to be coupled to the air outlet port of the air pump, and permits air flow from the air outlet port into the inflatable article for inflating the inflatable article. The air outlet is formed in the skirt flange, and is adapted to be in fluid communication with an interior of the inflatable article. The closure member is mounted on the air outlet for closing selectively the air outlet.

According to another aspect of this invention, an air inflatable assembly comprises an inflatable article, a motor-driven air pump, and an inflation seat assembly. The inflatable article is formed with an opening. The motor-driven air pump has an air inlet port and an air outlet port, and is operable so as to draw air via the air inlet port and to supply air via the air outlet port. The inflation seat assembly includes a casing, an inlet check valve, an air outlet, and a closure member. The casing has a base wall, a peripheral wall extending in a transverse direction from a periphery of the base wall, and a skirt flange extending outwardly from the peripheral wall. The base wall and the peripheral wall cooperate to form a receiving space for retaining the air pump removably therein. The casing is extended into the inflatable article via the opening, and is connected sealingly to the inflatable article such that the receiving space is accessible externally of the inflatable article. The inlet check valve is disposed on the base wall, is coupled removably to the air outlet port of the air pump, and permits air flow from the air outlet port into the inflatable article for inflating the inflatable article. The air outlet is formed in the skirt flange, and is in fluid communication with an interior of the inflatable article. The closure member is mounted on the air outlet for closing selectively the air outlet.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
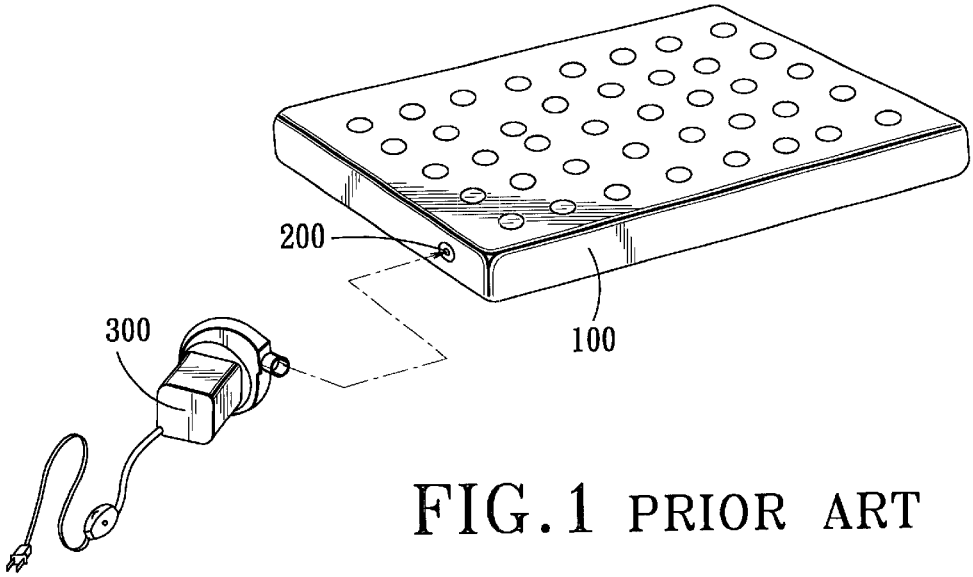
FIG.1 PRIOR ART
FIG. 1 is a perspective view of a conventional inflatable article.
Figure 2:
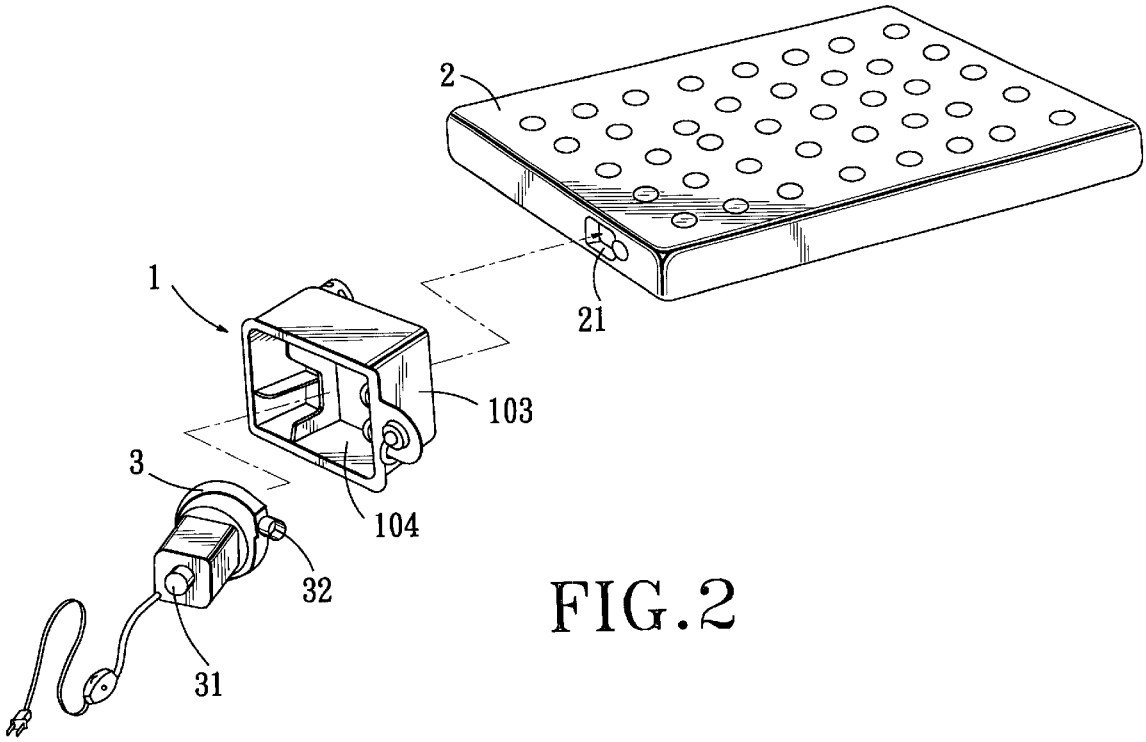
FIG. 2 is a perspective view of an air inflatable assembly that incorporates the preferred embodiment of an inflation seat assembly according to the present invention.
Figure 3:
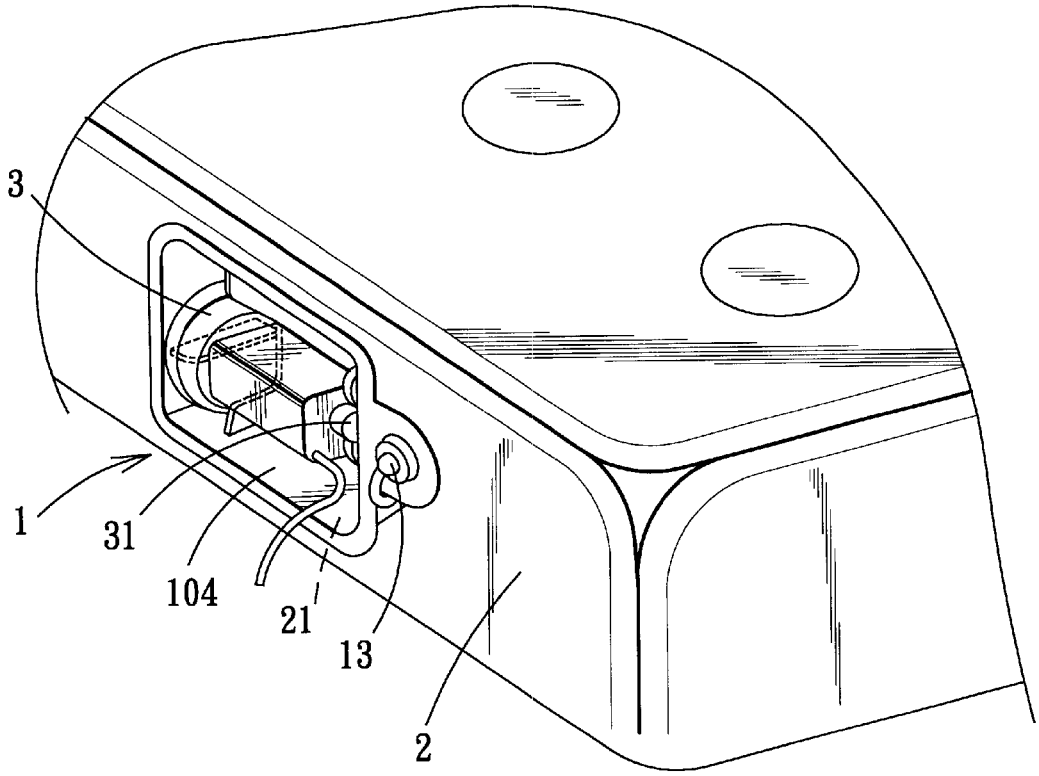
FIG. 3 is a fragmentary perspective view of the air inflatable assembly of FIG. 2 in an assembled state.
Figure 4:
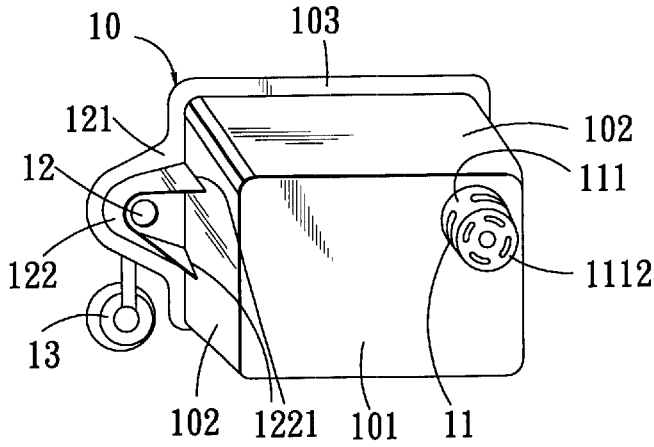
FIG. 4 is a rear perspective view of the air inflatable assembly of FIG. 2.
Figure 5:
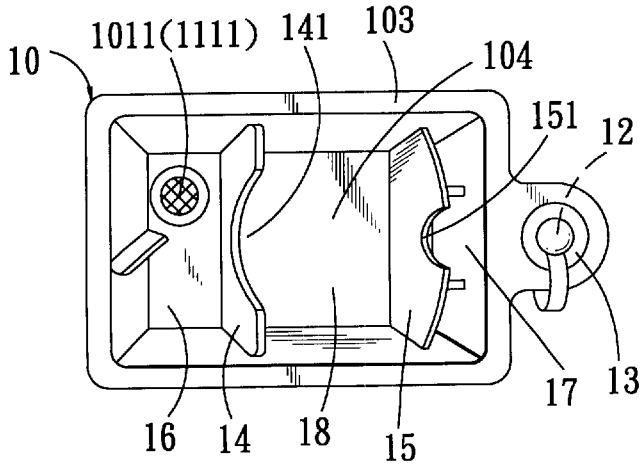
FIG. 5 is a schematic front view of the inflatable seat assembly of FIG. 2.

Referring to FIGS. 2 to 5, the preferred embodiment of an inflation seat assembly 1 according to the present invention is shown to be adapted for use in an air inflatable assembly that includes an inflatable article 2 and a motor-driven air pump 3. The air pump 3 has an air inlet port 31 and an air outlet port 32, and is operable so as to draw air via the air inlet port 31 and to supply air via the air outlet port 32. The inflation seat assembly 1 comprises a casing 10, an inlet check valve 11, an air outlet 12, and a closure member 13. The casing 10 has a base wall 101, a peripheral wall 102, a skirt flange 103, a pair of partition plates 14, 15, and a reinforcing rib 122, as best illustrated in FIGS. 4 and 5. The base wall 101 is formed with a mounting hole 1011. The peripheral wall 102 extends in a transverse direction from a periphery of the base wall 101. The base wall 101 and the peripheral wall 102 cooperate to form a receiving space 104 that is adapted to retain the air pump 3 removably therein. The skirt flange 103 extends outwardly from the peripheral wall 102, is disposed on a plane parallel to the base wall 101, and has a projecting section 121 that is formed with the air outlet 12. Each of the partition plates 14, 15 extends from the base wall 101 into the receiving space 104, and divides the receiving space 104 into a first section 16, a second section 17, and a third section 18. The third section 18 is between the first and second sections 16, 17, and is adapted to receive the air pump 3 removably therein. Each of the partition plates 14, 15 further has a distal edge opposite to the base wall 101 and formed with a notch 141, 151. The notches 141, 151 of the partition plates 14, 15 are adapted to permit a respective one of the air inlet and air outlet ports 31, 32 of the air pump 3 to extend removably therethrough. The reinforcing rib 122 extends from the projecting section 121 along a periphery of the air outlet 12, and has opposite ends 1221 connected to the peripheral wall 102 of the casing 10, thereby reinforcing the projecting section 121 so as to protect the same from breaking. The casing 10 is adapted to be extended into the inflatable article 2 via an opening 21 in the latter, and is adapted to be connected sealingly to the inflatable article 2 such that the receiving space 104 is accessible externally of the inflatable article 2.

Figure 6:
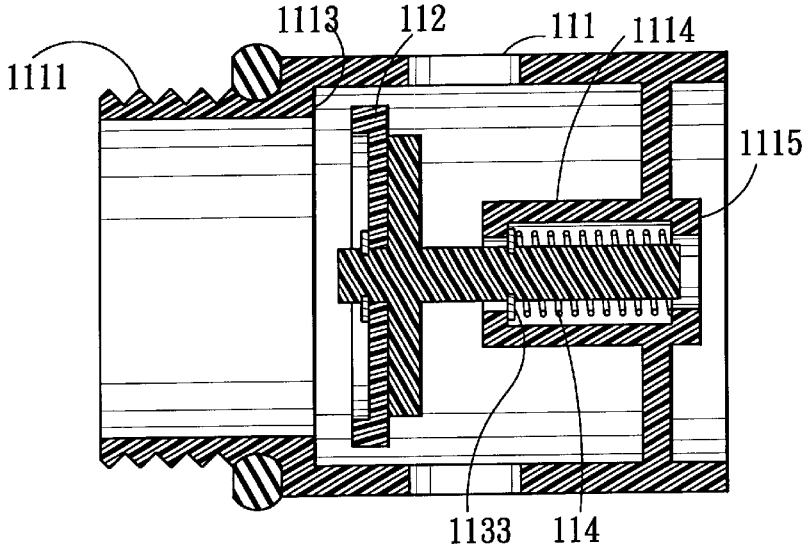
FIG. 6 is a cross-sectional view of an inlet check valve of the inflatable seat assembly.
Figure 7:
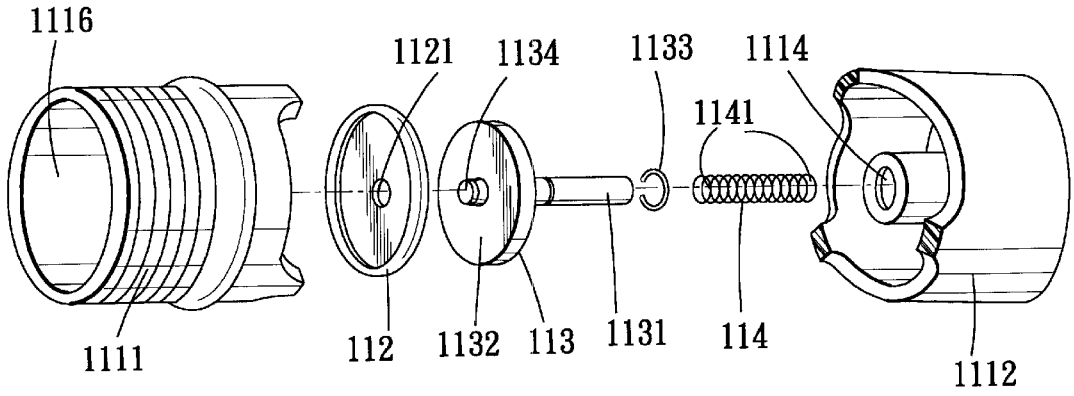
FIG. 7 is an exploded perspective view of the inlet check valve of FIG. 6, with a perforated wall portion of a tubular valve housing cut into two for the sake of clarity.

The inlet check valve 11 is disposed on the base wall 101, is adapted to be coupled removably to the air outlet port 32 of the air pump 3, and permits air flow from the air outlet port 32 into the inflatable article 2 for inflating the inflatable article 2. As shown in FIGS. 6 and 7, the inlet check valve 11 includes a tubular valve housing 111, a gasket 112, a piston 113, and a biasing member 114. The tubular valve housing 111 has a mounting wall portion 1111, a perforated wall portion 1112, an annular valve seat 1113, and a shaft guiding tube 1114. The mounting wall portion 1111 is mounted threadedly to the base wall 101 at the mounting hole 1011, and confines a coupling hole 1116 for coupling with the air outlet port 32 of the air pump 3. The perforated wall portion 1112 extends from the mounting wall portion 1111. The annular valve seat 1113 is formed at a juncture of the mounting and perforated wall portions 1111, 1112. The shaft guiding tube 1114 is connected to and is disposed coaxially in the perforated wall portion 1112, and has one end formed with a radial inward spring support flange 1115. The gasket 112 is disposed in the perforated wall portion 1112, and has a through-hole 1121. The piston 113 has a piston shaft 1131 and an urging plate 1132. The piston shaft 1131 extends slidably into the shaft guiding tube 1114, and has a spring support ring 1133 mounted thereon. The urging plate 1132 is formed on one end of the piston shaft 1131, and has a protrusion 1134 that extends into the through-hole 1121 in the gasket 112. The urging plate 1132 is disposed on one side of the gasket 112 opposite to the valve seat 1113. The biasing member 114 is a coil spring sleeved on the piston shaft 1131, is disposed in the shaft guiding tube 1114, and has opposite ends 1141 abutting against the spring support flange 1115 and the spring support ring 1133, respectively, thereby biasing the piston 113 to push the gasket 112 to seal the valve seat 1113, and thereby preventing the air in the inflatable article 2 from escaping via the inlet check valve 11.

The air outlet 12, which is formed in the skirt flange 103, is adapted to be in fluid communication with an interior of the inflatable article 2, and is adapted to be coupled removably to the air inlet port 31 of the air pump 3.

The closure member 13 is mounted on the air outlet silo 12 for closing selectively the air outlet 12.

In use, the air outlet port 32 of the air pump 3 is coupled to the valve housing 111 of the inlet check valve 11 so that air flow from the former pushes the gasket 112 and the piston 113 against the action of the biasing member 114, and enters into the inflatable article 2 via the perforated wall portion 1112 of the valve housing 111, thereby inflating the article 2. To deflate the article 2, the closure member 19 is removed from the air outlet 12, and the air inlet port 31 of the air pump 3 is coupled to the air outlet 12 so as to draw air from the article 2.

It has thus been shown that the inlet check valve 11 on the casing 10 can effectively guard against the undesired escape of air from the article 2. In addition, the inlet check valve 11 and the air outlet 12 can be coupled to the air pump 3 to facilitate inflation and deflation of the article 2. The object of the present invention is thus achieved.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An inflation seat assembly for connecting an inflatable article to a motor-driven air pump, the air pump having an air inlet port and an air outlet port and being operable so as to draw air via the air inlet port and to supply air via the air outlet port, said inflation seat assembly comprising:

a casing having a base wall, a peripheral wall extending in a transverse direction from a periphery of said base wall, and a skirt flange extending outwardly from said peripheral wall, said base wall and said peripheral wall cooperating to form a receiving space that is adapted to retain the air pump removably therein, said casing being adapted to be extended into the inflatable article and being adapted to be connected sealingly to the inflatable article such that said receiving space is accessible externally of the inflatable article;

an inlet check valve disposed on said base wall, said inlet check valve being adapted to be coupled to the air outlet port of the air pump and permitting air flow from the air outlet port into the inflatable article for inflating the inflatable article;

an air outlet formed in said skirt flange and adapted to be in fluid communication with an interior of the inflatable article; and a closure member mounted on said air outlet for closing selectively said air outlet.

2. The inflation seat assembly of claim 1, wherein said casing further has a pair of partition plates, each of which extends from said base wall into said receiving space so as to divide said receiving space into a first section, a second section, and a third section between said first and second sections and adapted to receive the air pump therein, each of said partition plates having a distal edge opposite to said base wall and formed with a notch, said notches of said partition plates being adapted to permit a respective one of the air inlet and air outlet ports of the air pump to extend removably therethrough.

3. The inflation seat assembly of claim 1, wherein said skirt flange has a projecting section that is formed with said air outlet, said casing further having a reinforcing rib that extends from said projecting section along a periphery of said air outlet and that has opposite ends connected to said peripheral wall of said casing.

4. The inflation seat assembly of claim 1, wherein said base wall is formed with a mounting hole, said inlet check valve including:

a tubular valve housing having a mounting wall portion coupled to said base wall at said mounting hole, a perforated wall portion extending from said mounting wall portion, an annular valve seat formed at a juncture of said mounting and perforated wall portions, and a shaft guiding tube connected to and disposed coaxially in said perforated wall portion;

a gasket disposed in said perforated wall portion;

a piston having a piston shaft that extends slidably into said shaft guiding tube, and an urging plate formed on one end of said piston shaft and disposed on one side of said gasket opposite to said valve seat; and a biasing member disposed in said shaft guiding tube for biasing said piston to push said gasket to seal said valve seat, thereby preventing the air in the inflatable article from escaping via said inlet check valve.

5. The inflation seat assembly of claim 4, wherein said shaft guiding tube has one end formed with a radial inward spring support flange, said piston shaft having a spring support ring mounted thereon, said biasing member being a coil spring sleeved on said piston shaft and having opposite ends abutting against said spring support flange and said spring support ring, respectively.

6. The inflation seat assembly of claim 1, wherein said skirt flange is disposed on a plane that is parallel to said base wall of said casing.

7. The inflation seat assembly of claim 1, wherein said air outlet is adapted to be coupled removably to the air inlet port of the air pump.

8. An air inflatable assembly comprising:

an inflatable article formed with an opening;

a motor-driven air pump having an air inlet port and an air outlet port and operable so as to draw air via said air inlet port and to supply air via said air outlet port; and an inflation seat assembly including a casing having a base wall, a peripheral wall extending in a transverse direction from a periphery of said base wall, and a skirt flange extending outwardly from said peripheral wall, said base wall and said peripheral wall cooperating to form a receiving space for retaining said air pump removably therein, said casing being extended into said inflatable article via said opening and being connected sealingly to said inflatable article such that said receiving space is accessible externally of said inflatable article, an inlet check valve disposed on said base wall, said inlet check valve being coupled removably to said air outlet port of said air pump and permitting air flow from said air outlet port into said inflatable article for inflating said inflatable article, an air outlet formed in said skirt flange and in fluid communication with an interior of said inflatable article, and a closure member mounted on said air outlet for closing selectively said air outlet.

9. The air inflatable assembly of claim 8, wherein said casing further has a pair of partition plates, each of which extends from said base wall into said receiving space so as to divide said receiving space into a first section, a second section, and a third section between said first and second sections to receive said air pump therein, each of said partition plates having a distal edge opposite to said base wall and formed with a notch, said notches of said partition plates permitting a respective one of said air inlet and air outlet ports of said air pump to extend removably therethrough.

10. The air inflatable assembly of claim 8, wherein said, skirt flange has a projecting section that is formed with said air outlet, said casing further having a reinforcing rib that extends from said projecting section along a periphery of said air outlet and that has opposite ends connected to said peripheral wall of said casing.

11. The air inflatable assembly of claim 8, wherein said base wall is formed with a mounting hole, said inlet check valve including:

a tubular valve housing having a mounting wall portion coupled to said base wall at said mounting hole, a perforated wall portion extending from said mounting wall portion, an annular valve seat formed at a juncture of said mounting and perforated wall portions, and a shaft guiding tube connected to and disposed coaxially in said perforated wall portion;

a gasket disposed in said perforated wall portion;

a piston having a piston shaft that extends slidably into said shaft guiding tube, and an urging plate formed on one end of said piston shaft and disposed on one side of said gasket opposite to said valve seat; and a biasing member disposed in said shaft guiding tube for biasing said piston to push said gasket to seal said valve seat, thereby preventing the air in said inflatable article from escaping via said inlet check valve.

12. The air inflatable assembly of claim 11, wherein said shaft guiding tube has one end formed with a radial inward spring support flange, said piston shaft having a spring support ring mounted thereon, said biasing member being a coil spring sleeved on said piston shaft and having opposite ends abutting against said spring support flange and said spring support ring, respectively.

13. The air inflatable assembly of claim 8, wherein said skirt flange is disposed on a plane that is parallel to said base wall of said casing.

14. The air inflatable assembly of claim 8, wherein said air outlet is coupled removably to said air inlet port of said air pump.

* * * * *